US006882114B2

(12) United States Patent
Takamori et al.

(10) Patent No.: US 6,882,114 B2
(45) Date of Patent: Apr. 19, 2005

(54) PLASMA DISPLAY PANEL

(75) Inventors: Takahiro Takamori, Kawasaki (JP); Tadatsugu Hirose, Kawasaki (JP); Shigeki Kameyama, Kawasaki (JP); Tomokatsu Kishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 326 days.

(21) Appl. No.: 10/028,442

(22) Filed: Dec. 28, 2001

(65) Prior Publication Data

US 2002/0047582 A1 Apr. 25, 2002

Related U.S. Application Data

(62) Division of application No. 09/488,018, filed on Jan. 20, 2000, now Pat. No. 6,353,292.

(30) Foreign Application Priority Data

Mar. 18, 1999 (JP) ..... 11-074478

(51) Int. Cl.[7] ..... H01J 17/49

(52) U.S. Cl. ..... 315/169.4; 315/169.3; 313/491; 345/77

(58) Field of Search ..... 315/169.3, 169.4, 315/167; 313/495, 491, 584, 586, 292; 345/690, 208, 214, 76, 77

(56) References Cited

U.S. PATENT DOCUMENTS

| | | | | |
|---|---|---|---|---|
| 5,587,624 | A | 12/1996 | Komaki | 313/584 |
| 5,640,068 | A * | 6/1997 | Amemiya | 313/582 |
| 5,962,974 | A * | 10/1999 | Komaki et al. | 313/582 |
| 6,084,349 | A * | 7/2000 | Ueoka et al. | 313/587 |
| 6,137,226 | A | 10/2000 | Nagano | 313/582 |
| 6,157,355 | A * | 12/2000 | Ide | 345/60 |
| 6,172,461 | B1 * | 1/2001 | Ha | 313/585 |
| 6,348,762 | B1 | 2/2002 | Nunomura et al. | 313/582 |
| 6,428,377 | B1 * | 8/2002 | Choi | 445/24 |
| 6,452,333 | B1 | 9/2002 | Torisaki et al. | 313/586 |
| 6,636,187 | B1 * | 10/2003 | Tajima et al. | 345/55 |
| 2002/0180354 | A1 * | 12/2002 | Sano et al. | 313/582 |

FOREIGN PATENT DOCUMENTS

| | | |
|---|---|---|
| EP | 6-251713 | 9/1994 |
| EP | 11-7896 | 11/1999 |
| EP | 0 966 017 A2 | 12/1999 |
| EP | 1 030 340 A2 | 8/2000 |
| JP | 7-288087 | 10/1995 |
| JP | 8-190869 | 7/1996 |
| JP | 10-092326 | 4/1998 |
| JP | 10-247072 | 9/1998 |
| JP | 11-54047 | 2/1999 |
| JP | 2000-123748 | 4/2000 |
| WO | W97/11477 | 3/1997 |

OTHER PUBLICATIONS

U.S. Appl. No. 09/460,459, Dec. 13, 1999, inventor Namiki Fumihiro.

* cited by examiner

*Primary Examiner*—Wilson Lee
*Assistant Examiner*—Thuy Vinh Tran
(74) *Attorney, Agent, or Firm*—Staas & Halsey LLP

(57) ABSTRACT

A plasma display panel comprising plural kinds of phosphors, each of which emits a light having a different kind of color, separators which separate the plural kinds of phosphors, and discharge cells having sustain electrode pairs which create discharges producing the light emissions from the phosphors. In the plasma display panel, sustain discharge currents through the sustain electrode pairs in the discharge cells are set at different values according to respective brightness of the lights emitted from the plural kinds of phosphors.

12 Claims, 19 Drawing Sheets

FIG. 5A
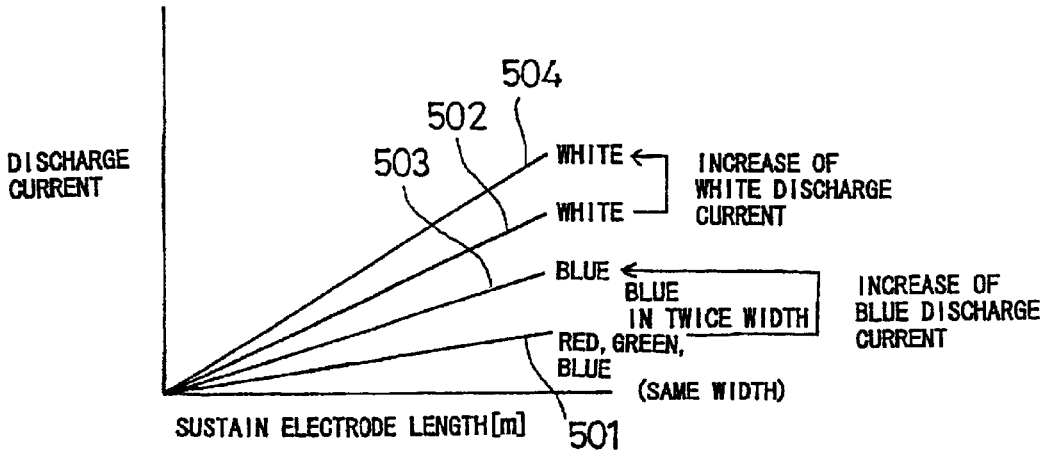
RELATIONSHIP BETWEEN SUSTAIN ELECTRODE SIZE AND DISCHARGE CURRENT
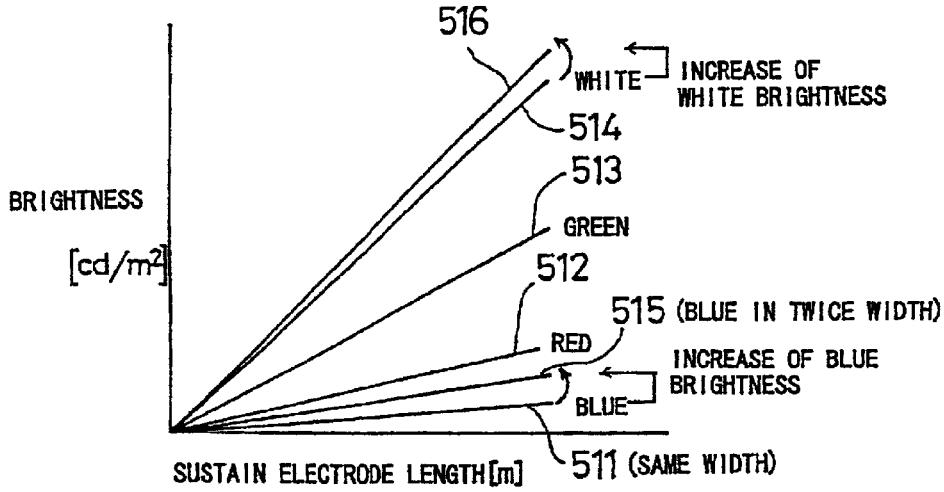
RELATIONSHIP BETWEEN SUSTAIN ELECTRODE AREA AND BRIGHTNESS
FIG. 5B

CROSS SECTION OF PDP

DISCHARGE CURRENT WAVEFORM

CHROMATICITY DIAGRAM

FIG.8A
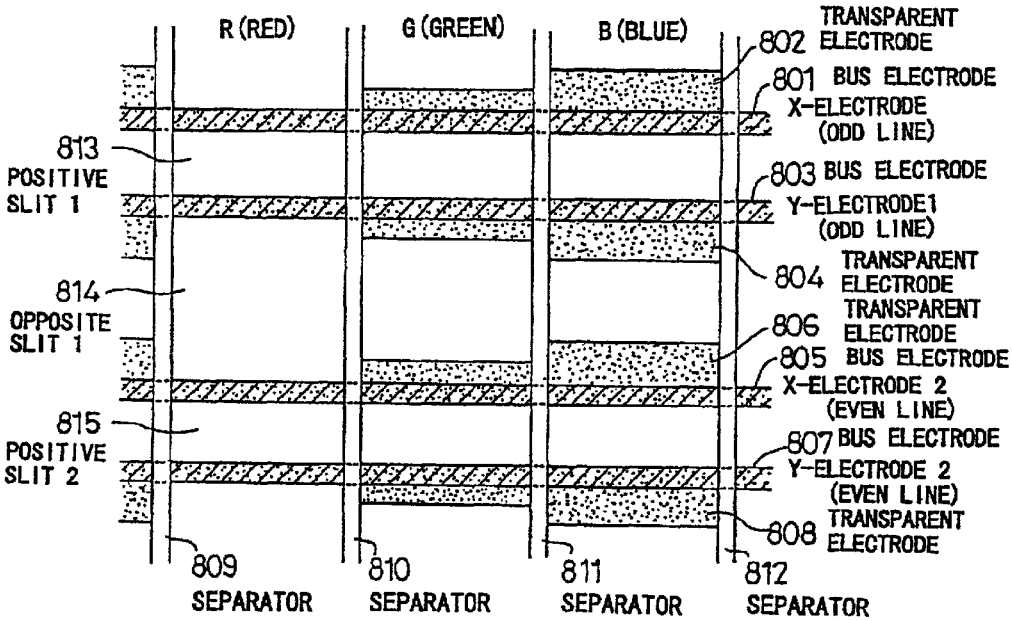
PLAN VIEW OF SUSTAIN ELECTRODE
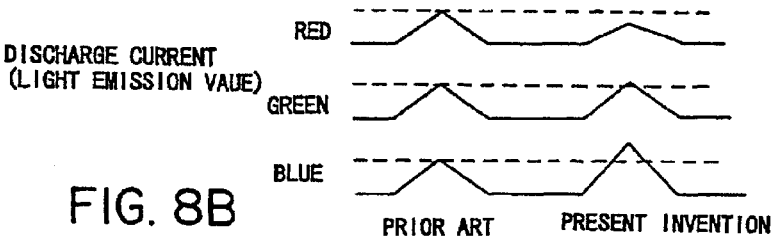
FIG. 8B
DISCHARGE CURRENT WAVEFORM

PLASMA DISPLAY PANEL

This application is a divisional application of U.S. application Ser. No. 09/488,018, filed on Jan. 20, 2000, now U.S. Pat. No. 6,353,292.

BACKGROUND OF THE INVENTION

1. Field of the Invention

The present invention generally relates to a plasma display panel (PDP), and more particularly to a color plasma display panel in which a white color temperature is increased based on improvements of sustain electrodes.

2. Description of the Related Art

Recently, in the field of display apparatuses, a complexity of information to be displayed, a size of a display panel and a definition of a display panel are increasing rapidly. Therefore, an improvement of a display quality of a PDP is required. The PDP is being developed at a rapid pace because the PDP has advantageous characteristics, for example, no-flicker, ease of achieving a large panel, a high brightness and a long lifetime. There are two types of AC-PDPs. One type has two electrodes which create a selection discharge (an address-discharge) and a sustain discharge between the two electrodes. The other type has three electrodes, the third electrode of which creates address-discharges. In a gray-scale color PDP, the phosphors placed in discharge-cells are excited by an ultraviolet light generated by discharges. The phosphors are degraded by ionic bombardments simultaneously generated by the discharges. In the PDP having two electrodes, the phosphors are directly bombard by the ions. This may results in a short lifetime of the phosphors. To avoid the short lifetime of the phosphors, three electrodes generating a surface discharge are generally used in the color PDP. There are types of PDPs having the three electrodes. One type has the third electrode on the same substrate as that on which the first and the second electrodes are provided and the other type has the third electrode on a separate substrate which is opposite to the substrate having the first and the second electrodes. There are two types of PDPs having the three electrodes provided on the same substrate. One type has the third electrode deposited on the first and the second electrodes and the other type has the third electrode deposited under the first and the second electrodes. Furthermore, in a transmission type PDP, a light emitted from the phosphor can be seen through the phosphor, and in a reflection type PDP, a light reflected from the phosphor can be seen. Discharge cells are separated from adjacent discharge cells by separators. Each discharge cell may be sealed by surrounding separators. Otherwise, separators may be provided in only one direction of each discharge cell and each cell is isolated in another direction by an action of an electric field generated by proper gaps between the electrodes.

FIG. 1 shows a plan view of a PDP of one example according to the prior art. Two sustain electrodes, such as an X-electrode 101 (the first electrode) and Y-electrodes 102 to 106 (the second electrodes) are deposited on a substrate. Address electrodes 107 to 116 (the third electrodes) are provided on another substrate. Then, these two substrates are sealed together. Separators 117 to 127 are created perpendicular to a surface of the substrates. Separators 117 to 127 are also perpendicular to the X-electrode 101 and the Y-electrodes 102 to 106 and parallel to the address electrodes 107 to 116. Each of the X-electrode 101 and the Y-electrodes 102 to 106 has a transparent electrode in part. This PDP is the reflection-type PDP. Therefore, a light reflected from the phosphor can be seen.

FIG. 2 shows a cross section in a direction parallel to the address electrodes 107 to 116 of the PDP shown in FIG. 1. The PDP comprises a front glass substrate 201 and a rear glass substrate 202. Sustain electrodes which comprise the X-electrode and the Y-electrodes are deposited on the front glass substrate 201. The X-electrode has a transparent electrode 203 and a bus electrode 204. The Y-electrode has a transparent electrode 205 and a bus electrode 206. The transparent electrodes 203 and 205 are made up of an ITO which is a transparent conductive film of mainly indium oxide because they must transmit a light reflected from a phosphor. A resistance of the bus electrodes 204, 206 and 208 is needed to be low to prevent a voltage drop caused by the electrode resistance. Therefore, the bus electrodes 204, 206 and 208 are made up of chrome or copper. The X-electrode and the Y-electrodes are covered with a dielectric layer 209. Furthermore, a magnesium oxide protection layer 210 is provided on the dielectric layer 209. A surface of the protection layer 210 is a discharge surface. The address electrode 211 is deposited on the rear glass substrate 202 perpendicular to the X-electrode and the Y-electrodes which are deposited on the front glass substrate 201.

FIG. 3 shows a cross section in a direction parallel to the X-electrodes 101 of the PDP shown in FIG. 1. Separators 310, 311, 312 and 313 are deposited between address electrodes 307, 308 and 309. A red phosphor 314, a green phosphor 315 and a blue phosphor 316 are deposited on the address electrodes between the separators. The front glass substrate 301 and the rear glass substrate 302 are assembled so that tips of the separators 310 to 313 are sealed to a magnesium oxide layer 306.

FIG. 4 show a plan view of sustain electrodes for red, green and blue phosphors. A sustain electrode pair comprises an X-electrode 1 and a Y-electrode 1. The X-electrode 1 comprises a bus electrode 401 and a transparent electrode 402. The Y-electrode 1 comprises a bus electrode 403 and a transparent electrode 404. A sustain discharge is created at a slit 413 between the X-electrode 1 and the Y-electrode 1. This slit 413 is referred to as a positive slit 1. A slit 415 is also referred to as a positive slit 2. A sustain discharge is not created at a slit 414 between the X-electrode 2 and the Y-electrode 1. This slit 414 is referred to as an opposite slit 2. A red phosphor is deposited between separators 409 and 410 and a red light is emitted from the positive slit 1 between separators 409 and 410 when a sustain discharge is created at the positive slit 1. A green phosphor is deposited between separators 410 and 411, and a blue phosphor is deposited between separators 411 and 412. A green light and a blue light are also emitted from the positive slit 1 when a sustain discharge is created at the positive slit 1. Address electrodes not shown in FIG. 4 are provided parallel to the separators. FIG. 5 shows a relationship among a sustain electrode size, a discharge current value and a brightness. FIG. 5 (A) shows a relationship between the sustain electrode size and the discharge current value. A solid line 501 shows a case where each sustain electrode provided for the red, green and blue phosphor cells has the same width. In this case, each discharge current at the red, green and blue phosphor cells has the same value despite the sustain electrode size. As a result, each ultraviolet ray generated by a discharge to excite the red, green and blue phosphor cells has the same strength.

However, each luminous efficiency and maximum brightness of the red, green and blue phosphors are different from each other. Therefore, a brightness of a particular color is lower than those of other colors even if each phosphor is excited by the ultra violet ray having the same strength generated by the discharge having the same strength. As a result, a white color temperature is reduced and this results in a degradation of a display quality.

For example, FIG. 5 (B) shows a relationship between the sustain electrode size and the brightness. As described above, in case that each sustain electrode provided for the red, green and blue phosphor cells has the same width, the red, green and blue phosphor cells are excited by ultraviolet rays having the same strength. A blue brightness 51 1, a red brightness 512 and a green brightness 513 are different from each other. The blue brightness 511 is the lowest of the three. As a result, the white color temperature is low.

SUMMARY OF THE INVENTION

It is a general object of the present invention to provide a plasma display panel in which the above disadvantages are eliminated. A more specific object of the present invention is to provide a plasma display panel in which a white color temperature is increased.

The above objects of the present invention are achieved by a plasma display panel comprising plural kinds of phosphors, each of which emits a light having a different kind of color, separators which separate the plural kinds of phosphors and discharge cells having sustain electrode pairs which create discharges to create the light emissions from the phosphors. In the plasma display panel, a sustain discharge current through each sustain electrode pair in the discharge cells is set a different value according to a brightness of each light emitted from the plural kinds of phosphors.

According to the invention, a white color temperature is increased because the brightness of a particular discharge cell which is defined by the separators surrounding a discharge space in which the phosphor having a low brightness is deposited is increased.

BRIEF DESCRIPTION OF THE DRAWINGS

Other objects, features and advantages of the present invention will become more apparent from the following detailed description when read in conjunction with the accompanying drawings, in which:

FIG. 5A shows a relationship between a sustain electrode size and a discharge current value and FIG. 5B, between sustain electrode area and brightness;

FIG. 8A shows a plan view of a PDP and discharge currents of a second embodiment according to the present invention and FIG. 8B shows related discharge current waveforms;

DESCRIPTION OF THE PREFERRED EMBODIMENTS

Figure 1:
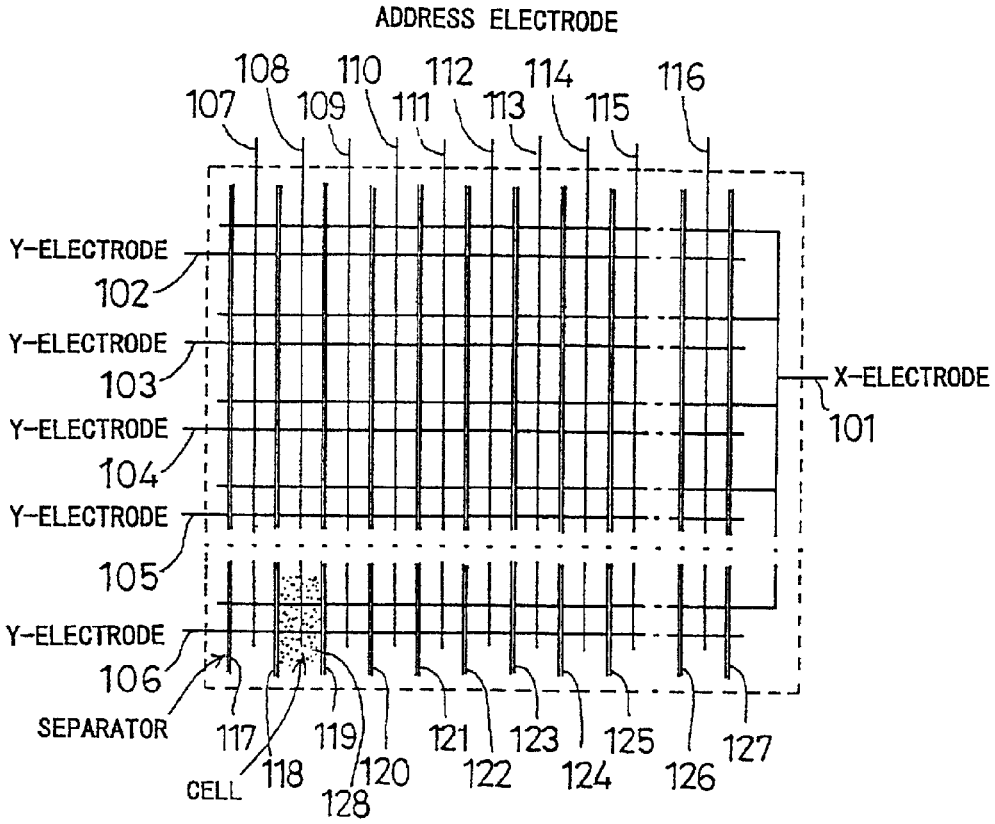
FIG.1 PRIOR ART
FIG. 1 shows a plan view of a PDP of one example according to the prior art.
Figure 6A:
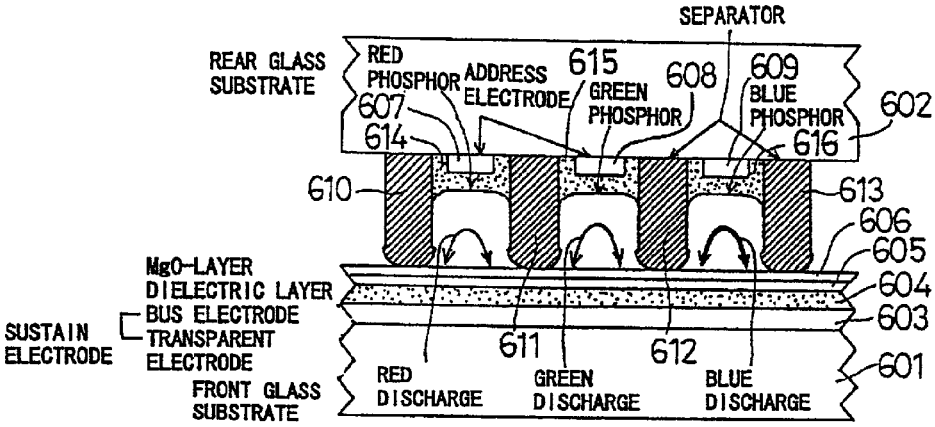
FIG. 6A shows a principle of the present invention.
Figure 6B:
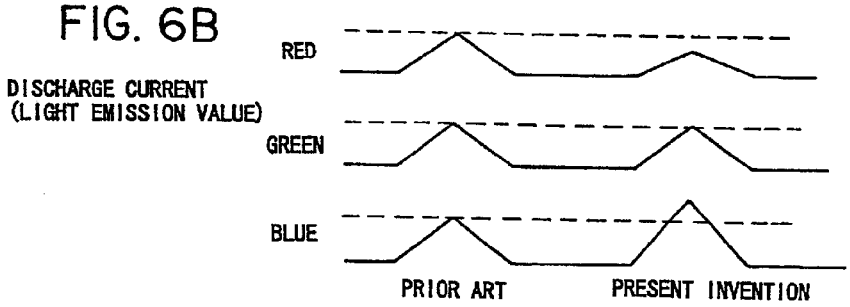
FIG. 6B shows discharge current for sustain electrodes.
Figure 6C:
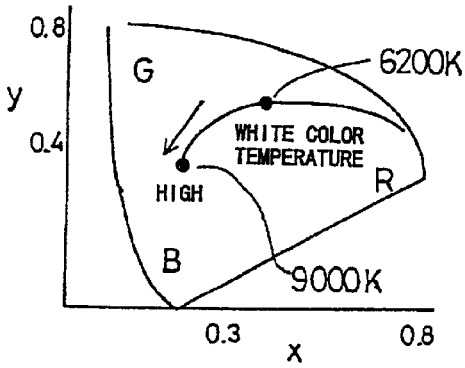
FIG. 6C shows a chromaticity diagram.

First a principle of the present invention will be explained. FIG. 6 shows the principle of the present invention and particularly a cross section of the PDP shown in FIG. 1. FIG. 6B shows discharge currents for sustain electrodes. FIG. 6C is a chromaticity diagram. FIG. 6A shows the cross section in a direction parallel to the X-electrodes 101 of the PDP shown in FIG. 1. Separators, or barriers, 610, 611, 612 and 613 are deposited between address electrodes 607, 608 and 609. A red phosphor 614, a green phosphor 615 and a blue phosphor 616 are deposited on respective address electrodes between the separators. The front glass substrate 601 and the rear glass substrate 602 are assembled so that tips of the separators 610 to 613 are sealed to a magnesium oxide layer 606. In FIG. 6A, arrows in discharge spaces show discharge currents and the thicker arrow shows the larger discharge current. Conventionally, each discharge current at the electrodes for a red phosphor, a green phosphor and a blue phosphor had the same value. According to the present invention, the discharge current at the electrodes for the green phosphor is the same value as used in the conventional PDP, the discharge current at the electrodes for the red phosphor is smaller than that at the electrodes for the green phosphor and the discharge current at the electrodes for the blue phosphor is larger than that at the electrodes for the green phosphor, as shown in FIG. 6B. As a result, a white color temperature is increased from 6200 K to 9000 K as shown in FIG. 6C. That is to say, the white color temperature is increased by modifying each discharge current at the red, green and blue phosphors.

Figure 7:
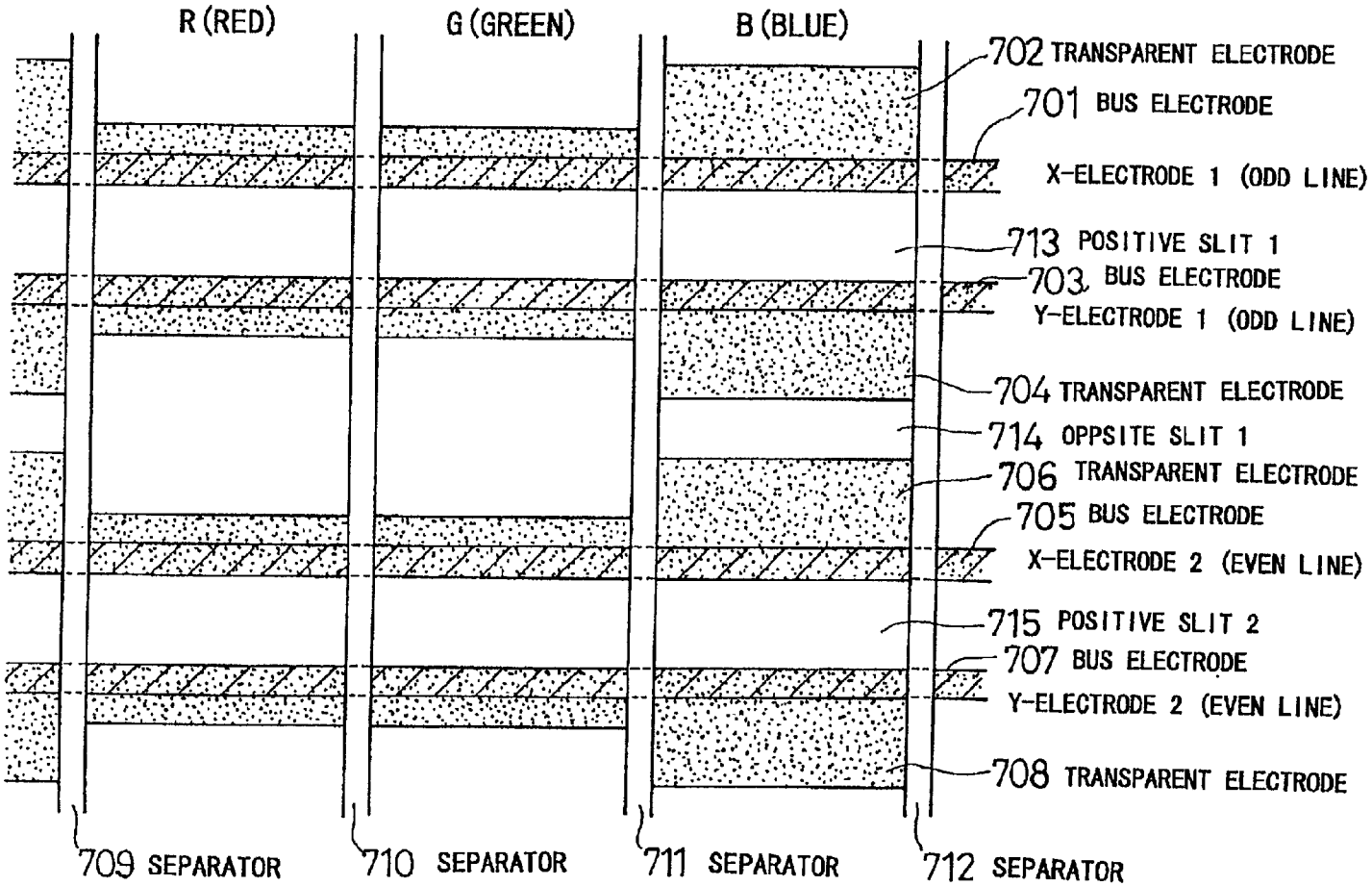
FIG. 7 shows a plan view of a PDP of a first embodiment according to the present invention.

Next, a first embodiment of the present invention will be explained. FIG. 7 shows a plan view of a PDP of the first embodiment according to the present invention. Transparent electrodes 702, 704, 706 and 708 in a blue phosphor cell (hereinafter referred to as blue electrodes) are extended to twice the size of the transparent electrodes in red and green phosphor cells (hereinafter referred to as red electrodes and green electrodes) in a direction of an opposite slit 714 which slit creates no discharge, while a distance between the transparent electrodes 702, 704 and 706, 708 at positive slits 713 and 715 which slits create discharges is unchanged. Therefore, a blue electrode discharge current is increased as shown by a solid line 503 in FIG. 5 (A). Therefore, a blue brightness is increased as shown by a solid line 515 in FIG. 5 (B). As a result, a white color temperature is increased because the blue brightness is increased relatively higher than the red brightness and the green brightness. The blue electrodes may be expanded to an arbitrary size other than twice the size of the red electrodes and the green electrodes.

Next, a second embodiment of the present invention will be explained. FIG. 8A shows a plan view of a PDP, and FIG. 8B shows discharge currents, of the second embodiment according to the present invention. In this embodiment, a discharge is created at positive slits 813 and 815. Blue electrodes and green electrodes of transparent electrodes 802, 804, 806 and 808 are expanded in a direction of an opposite slit 814, while a distance between the transparent electrodes 802, 804 and 806, 808 at the positive slits 813 and 815 is unchanged. Particularly, the blue electrodes are extended so as to be larger than the green electrodes. On the other hand, when a length of an opposite slit 814 becomes too short, the opposite slit 814 affects the discharge created at the adjacent positive slits 813 and 815. Therefore, each extension area size of the blue electrodes and the green electrodes is limited within a range in which the discharge at the positive slits 813 and 815 is created stably. FIG. 8B shows discharge current waveforms of the red electrode, the green electrode and the blue electrode. Conventionally, each discharge current at the red electrodes, the green electrodes and the blue electrodes had the same value. As the extension area size of each electrode is modified according to the present invention, as mentioned above, the discharge current at the green electrodes is the same value as used in the conventional PDP, the discharge current at the red electrodes is smaller than that at the green electrodes and the discharge current at the blue electrodes is larger than that at the green electrodes, as shown in FIG. 8B. As a result, a white color temperature is increased because the brightness of each color can be adjusted relatively as mentioned above.

Figure 9:
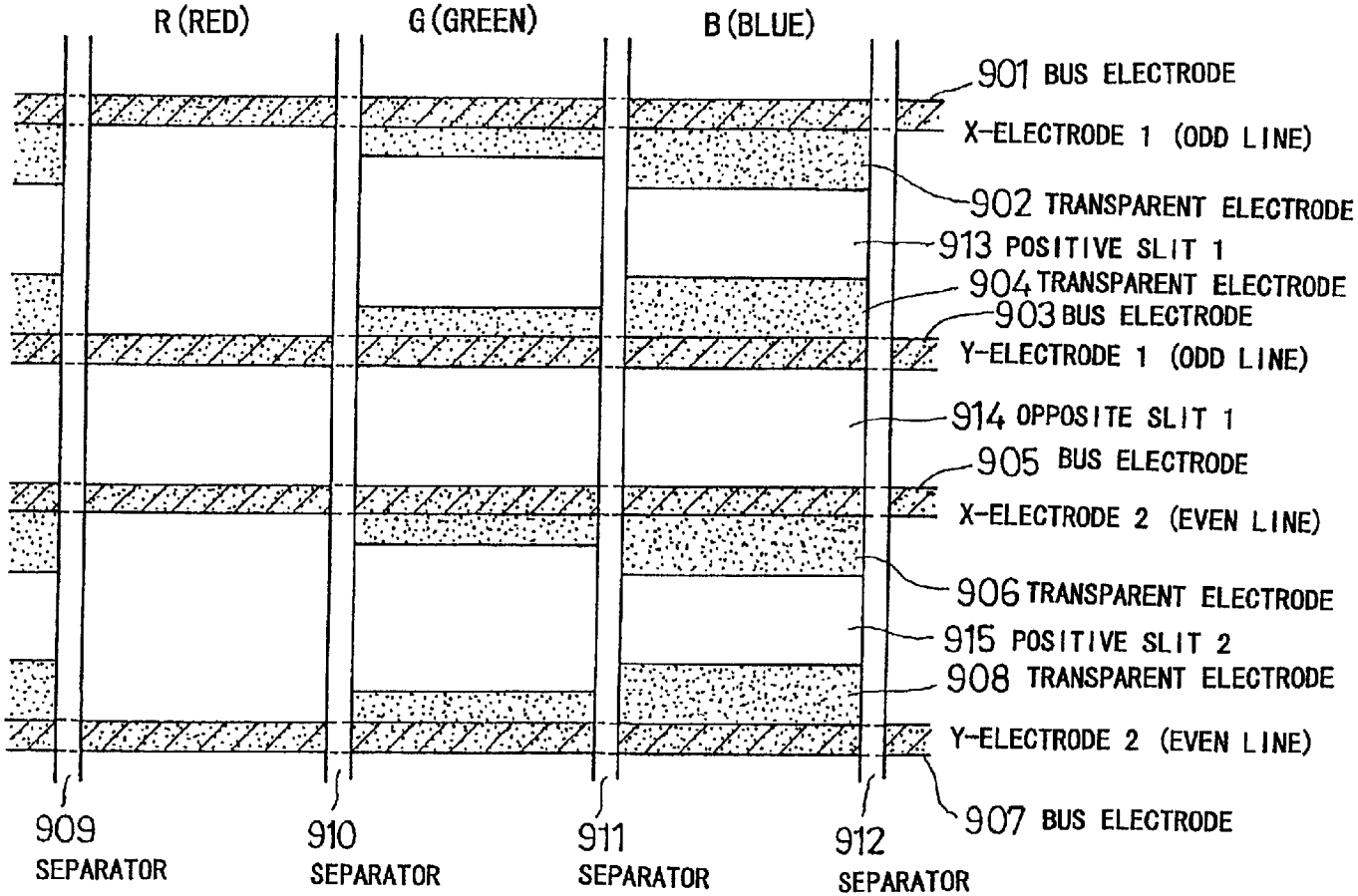
FIG. 9 shows a plan view of a PDP of a third embodiment according to the present invention.

Next, a third embodiment of the present invention will be explained. FIG. 9 shows a plan view of a PDP of the third embodiment according to the present invention. Blue electrodes and green electrodes of transparent electrodes 902, 904, 906 and 908 are extended in a direction of positive slits 913 and 915, while a distance between the transparent electrodes 902, 904 and 906, 908 at the opposite slit 914 is unchanged. Particularly, the blue electrodes are extended so as to be larger than the green electrodes. On the other hand, when respective, individual lengths of the positive slits 913 and 915 between the red electrodes, the green electrodes and the blue electrodes differ from each other, the respective, individual discharge starting voltages at the red electrodes, the green electrodes and the blue electrodes have different values. Therefore, the respective individual extension area sizes of the three kinds of electrodes are each limited within a range in which all the discharges at the positive slits 913 and 915 are created stably. As a result, a white color temperature is increased because the brightness of each color cell can be adjusted relatively by modifying each size of the transparent electrodes 902, 904, 906 and 908 in each color cell as mentioned above.

Figure 10:
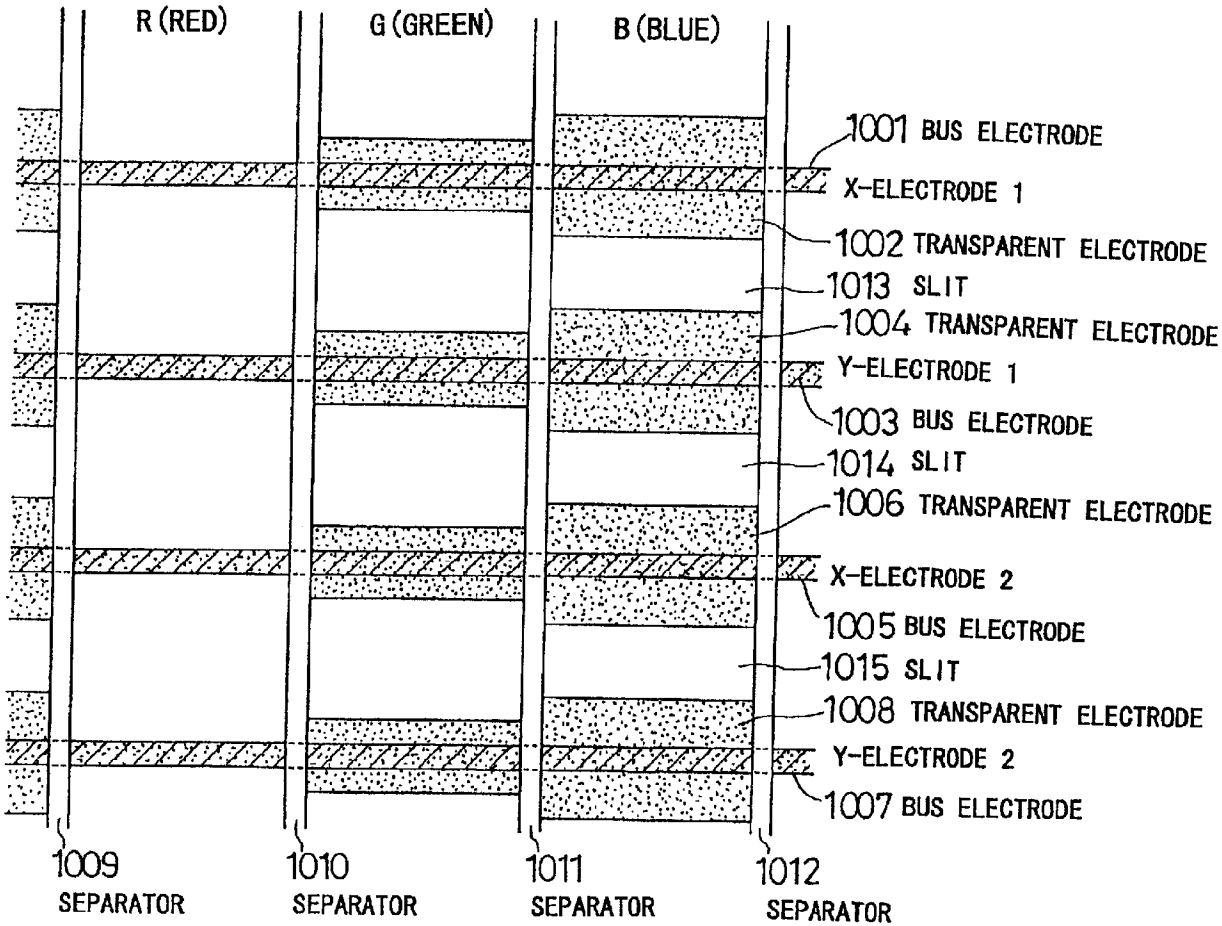
FIG. 10 shows a plan view of a PDP of a fourth embodiment according to the present invention.
Figure 11:
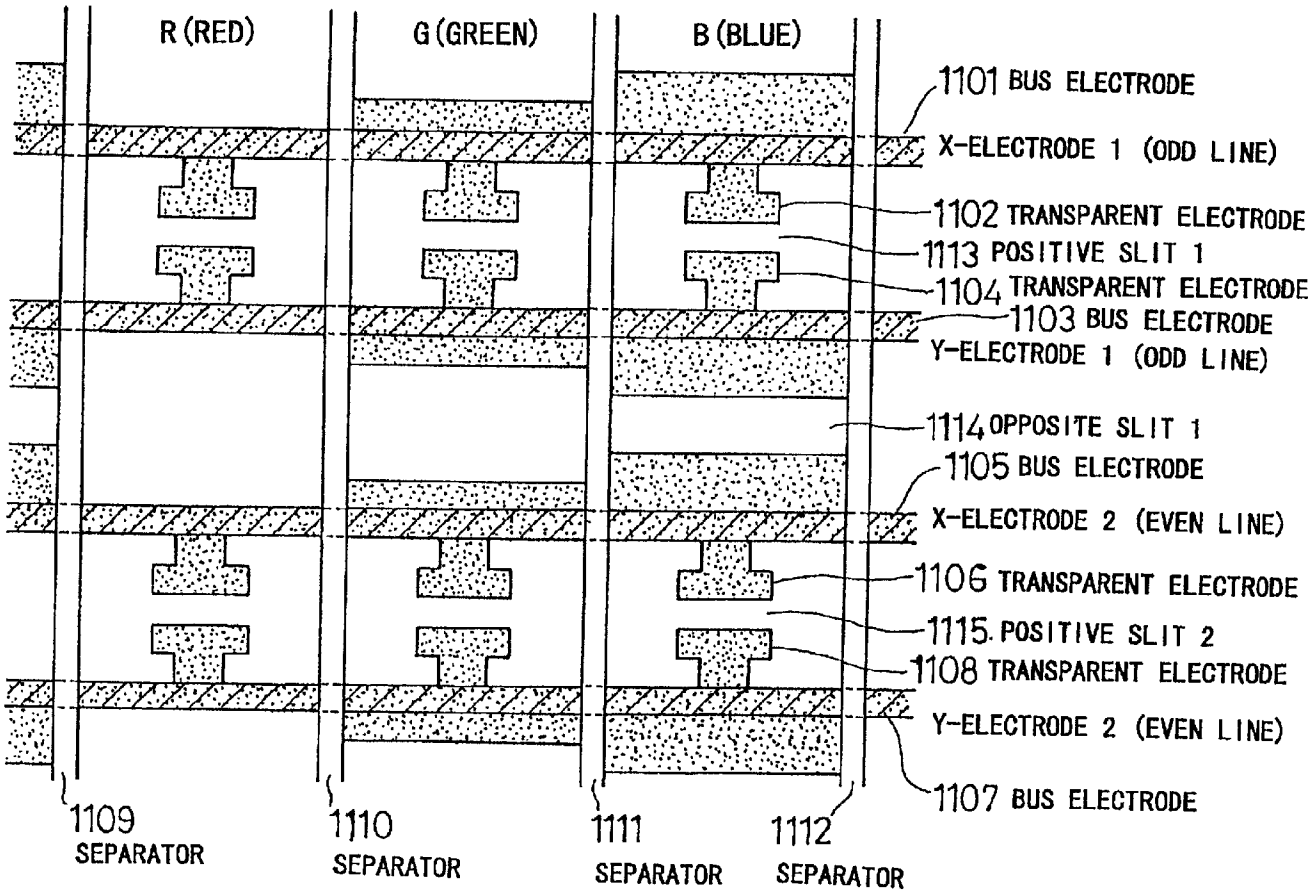
FIG. 11 shows a plan view of a PDP of a fifth embodiment according to the present invention.

Next, a fourth embodiment of the present invention will be explained. FIG. 10 shows a plan view of a PDP of the fourth embodiment according to the present invention. In this embodiment, a discharge is alternatively created at adjacent slits 1013, 1014 and 1015. That is, discharges are simultaneously created in both the slit 1013 between the transparent electrodes 1002 and 1004 and the slit 1015 between the transparent electrodes 1006 and 1008, then, a discharge is created in the slit 1014 between the transparent electrodes 1004 and 1006 at a next time. In this embodiment, transparent electrodes 1002, 1004, 1006 and 1008 are extended in a direction of both slits in which discharges are alternatively created, as mentioned above, at each phosphor cell. Particularly, blue electrodes are extended so as to be larger than green electrodes. When respective, individual lengths of the slits 1013, 1014 and 1015 between the red electrodes, the green electrodes and the blue electrodes differ from each other, each of the discharge starting voltages at the red electrodes, the green electrodes and the blue electrodes has a different value. Therefore, the respective extension area sizes of the three kinds of electrodes the respective extension area sizes of the blue electrodes and the green electrodes are each limited within a range in which the discharge at the positive slits 1113 and 1115 is created stably. As a result, when the PDP has T-shaped parts in the positive slits 1113 and 1115 which create discharges, a white color temperature is increased because the brightness of each color cell can be adjusted relatively by modifying each size of the transparent electrodes 1102, 1104, 1106 and 1108 in each color cell as mentioned above.

Figure 12:
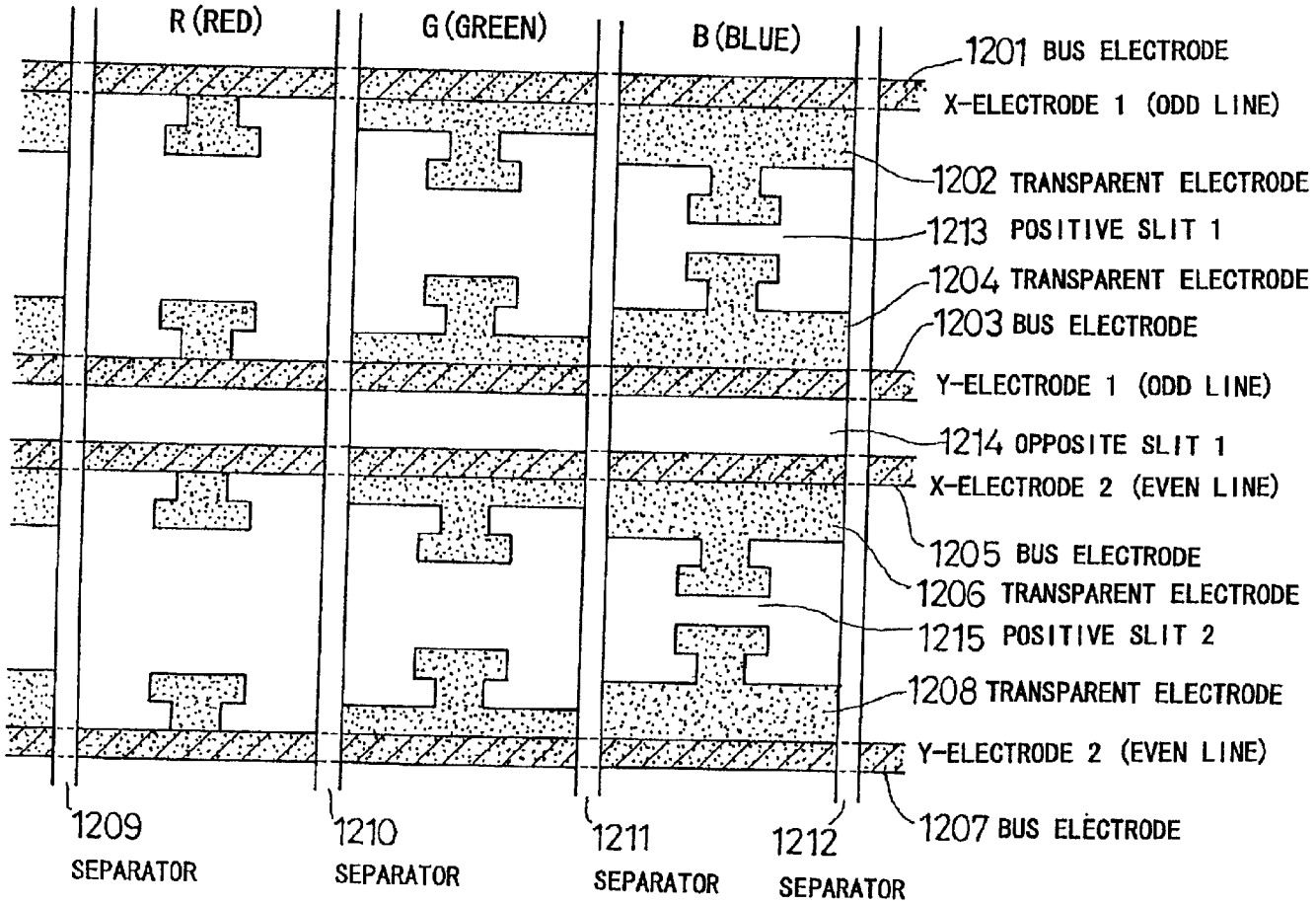
FIG. 12 shows a plan view of a PDP of a sixth embodiment according to the present invention.

Next, a sixth embodiment of the present invention will be explained. FIG. 12 shows a plan view of a PDP of the sixth embodiment according to the present invention. In this embodiment, transparent electrodes 1202, 1204, 1206 and 1208 have T-shaped parts in positive slits 1213 and 1215 of red, green and blue cells, which create discharges. Each T-shaped part comprises a narrow part and a wide part as shown in FIG. 12. Blue electrodes and green electrodes of transparent electrodes 1202, 1204, 1206 and 1208 are extended in a direction of positive slits 1213 and 1215 without changing a shape of T-shaped parts, while a distance between the transparent electrodes 1202, 1204, 1206 and 1208 at the negative slit 1214 is unchanged. Particularly, the blue electrodes are extended so as to be larger than the green electrodes. When the respective lengths of the positive slits 1213 and 1215 between the red electrodes, the green electrodes and the blue electrodes differ from each other, each of the respective discharge starting voltages at the positive slits 1213 and 1215 of the red electrodes, the green electrodes and the blue electrodes has a different value. Therefore, each of the respective extension area sizes of the three kinds of electrodes is limited within a range in which all the discharges at the slit 1213 and 1215 are created stably. As a result, when the PDP has T-shaped parts in the positive slits 1213 and 1215 which create discharges, a white color temperature is increased because the brightness of each color cell can be adjusted relatively by modifying each size of the transparent electrodes 1202, 1204, 1206 and 1208 in each color cell as mentioned above.

In this embodiment, the respective discharge starting voltages of the red electrodes, the green electrodes and the blue electrodes differ from each other, because each distance between T-shaped parts of the red electrodes, the green electrodes and the blue electrodes is modified. However, it is possible to have the same distance between T-shaped parts of the three kinds of electrodes so that each discharge starting voltage of the three kinds of electrodes may have the same value.

Figure 13:
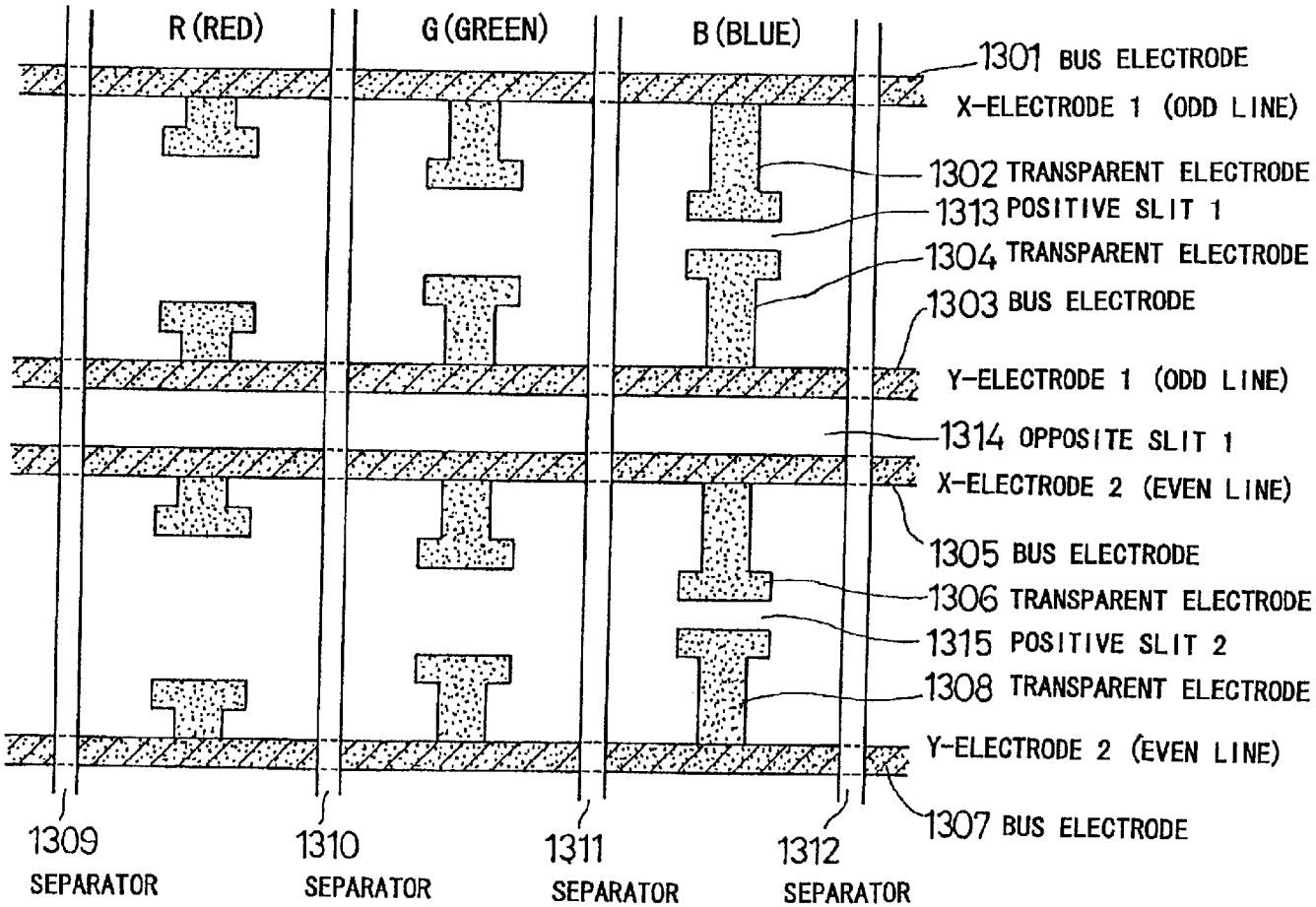
FIG. 13 shows a plan view of a PDP of a seventh embodiment according to the present invention.

Next, a seventh embodiment of the present invention will be explained. FIG. 13 shows a plan view of a PDP of the seventh embodiment according to the present invention. In this embodiment, transparent electrodes 1302, 1304, 1306 and 1308 have T-shaped parts in positive slits 1313 and 1315 of red, green and blue cells, which create discharges. Each T-shaped part comprises a narrow part and a wide part as shown in FIG. 13. The narrow parts of the T-shaped parts of the blue electrodes and green electrodes of the transparent electrodes 1302, 1304, 1306 and 1308 are expanded in a direction of positive slits 1313 and 1315, while a distance between the transparent electrodes 1302, 1304, 1306 and 1308 at the negative slit 1314 is unchanged. Particularly, the narrow parts of the T-shaped parts of the blue electrodes are expanded so as to be longer than that of the green electrodes. When the respective lengths of the positive slits 1313 and 1315 between the red electrodes, the green electrodes and the blue electrodes differ from each other, the respective discharge starting voltages at the positive slits 1313 and 1315 of the red electrodes, the green electrodes and the blue electrodes also have different values. Therefore, each length of the T-shaped parts of the three kinds of electrodes is limited within a range in which all the discharges at the slit 1313 and 1315 are created stably. As a result, when the PDP has T-shaped parts in the positive slits 1313 and 1315 which create discharges, a white color temperature is increased because the brightness of each color cell can be adjusted relatively by modifying each size of the transparent electrodes 1302, 1304, 1306 and 1308 in each color cell as mentioned above.

Figure 14:
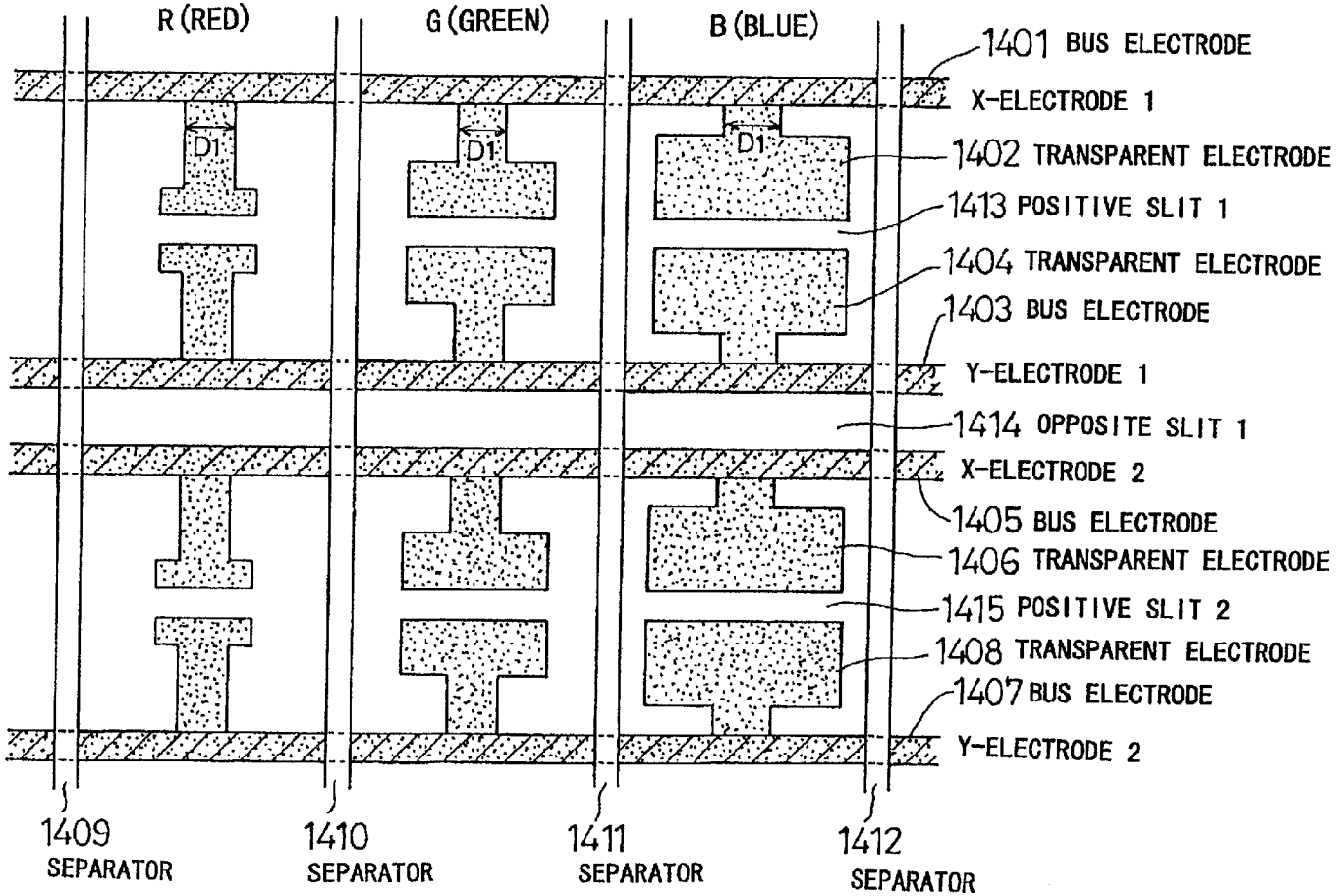
FIG. 14 shows a plan view of a PDP of an eighth embodiment according to the present invention.

Next, an eighth embodiment of the present invention will be explained. FIG. 14 shows a plan view of a PDP of the eighth embodiment according to the present invention. In this embodiment, transparent electrodes 1402, 1404, 1406 and 1408 have T-shaped parts in positive slits 1413 and 1415 of red, green and blue cells, which create discharges. Each T-shaped part comprises a narrow part and a wide part as shown in FIG. 14. A length of the wide parts of blue electrodes and a length of the wide parts of green electrodes of the transparent electrodes 1402, 1404, 1406 and 1408 are expanded, while a distance between the T-shaped parts of the transparent electrodes 1402, 1404, 1406 and 1408 at the positive slits 1413 and 1415, and a distance between the transparent electrodes 1402, 1404, 1406 and 1408 at the negative slit 1414 are unchanged. Particularly, the blue electrodes are expanded so as to be larger than the green electrodes. As a result, when the PDP has T-shaped parts in the positive slits 1413 and 1415 which create discharges, a white color temperature is increased because the brightness of each color cell can be adjusted relatively by modifying each size of the transparent electrodes 1402, 1404, 1406 and 1408 in each color cell as mentioned above.

Figure 15:
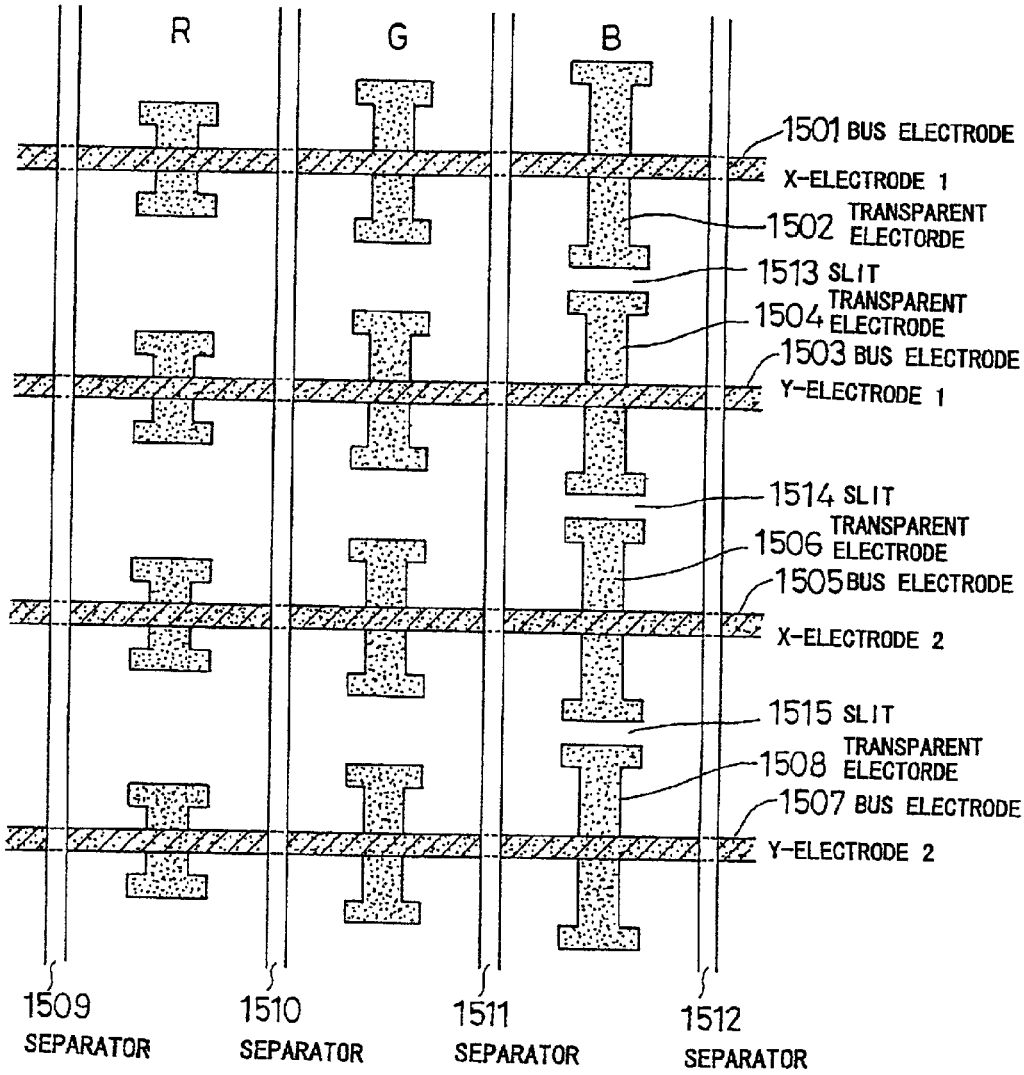
FIG. 15 shows a plan view of a PDP of a ninth embodiment according to the present invention.

Next, a ninth embodiment of the present invention will be explained. FIG. 15 shows a plan view of a PDP of the ninth embodiment according to the present invention. In this embodiment, transparent electrodes 1502, 1504, 1506 and 1508 have T-shaped parts in all slits 1413, 1414 and 1415 of red, green and blue cells, which alternately create discharges. Each T-shaped part comprises a narrow part and a wide part as shown in FIG. 15. In this embodiment, a discharge is alternatively created at adjacent slits 1513, 1514 and 1515. That is to say, discharges are simultaneously created in both the slit 1513 between the T-shaped part of the transparent electrode 1502 and the T-shaped part of the transparent electrode 1504 and the slit 1515 between the T-shaped part of the transparent electrode 1506 and the T-shaped part of the transparent electrode 1508. Then, a discharge is created in the slit 1514 between the T-shaped part of the transparent electrode 1504 and the T-shaped part of the transparent electrode 1506 at a next time. In this embodiment, the narrow parts of blue electrodes and green electrodes of the transparent electrodes 1502, 1504, 1506 and 1508 are extended in a direction of both slits in which discharges are alternatively created as mentioned above, at each phosphor cell. Particularly, the blue electrodes are extended so as to be larger than the green electrodes. When the respective lengths of the slits 1513, 1514 and 1515 between the red electrodes, the green electrodes and the blue electrodes differ from each other, the respective discharge starting voltages at the red electrodes, the green electrodes and the blue electrodes each has a different value. Therefore, the respective extension area sizes of the red electrodes, the green electrodes and the blue electrodes are each limited within a range in which all the discharges at the slits 1513, 1514 and 1515 are created stably. As a result, when the PDP has T-shaped parts in the slits 1513, 1514 and 1515 which alternatively create discharges, a white color temperature is increased because the brightness of each color cell can be adjusted relatively by modifying each size of the transparent electrodes 1502, 1504, 1506 and 1508 in each color cell as mentioned above.

Figure 16:
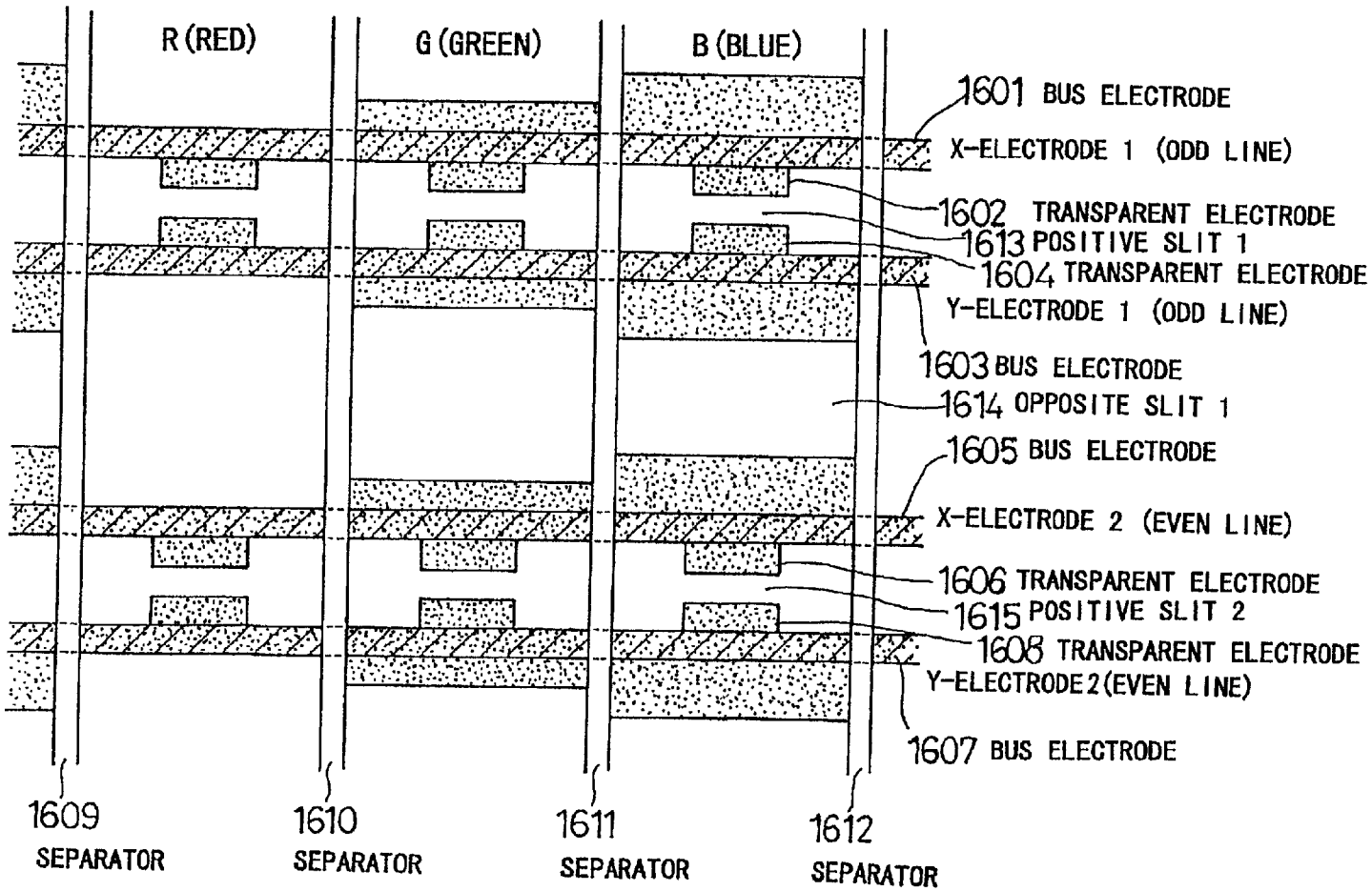
FIG. 16 shows a plan view of a PDP of a tenth embodiment according to the present invention.

Next, a tenth embodiment of the present invention will be explained. FIG. 16 shows a plan view of a PDP of the tenth embodiment according to the present invention. In this embodiment, each of transparent electrodes 1602, 1604, 1606 and 1608 has rectangular projections as shown in FIG. 16 in each of positive slits 1613 and 1615 of red, green and blue cells, which create discharges. Blue electrodes and green electrodes of the transparent electrodes 1602, 1604, 1606 and 1608 are extended in a direction of a negative slit 1614, while a distance between the rectangular projection of the transparent electrodes 1602, 1604, 1606 and 1608 at the positive slits 1613 and 1615 is unchanged. Particularly, the blue electrodes are extended so as to be larger than the green electrodes. In this case, when a length of an opposite slit 1614 becomes too short, the opposite slit 1614 affects the discharge created at the positive slits 1613 and 1615. Therefore, the respective extension area sizes of the blue electrodes and the green electrodes are each limited within a range in which the discharge at the positive slits 1613 and 1615 is created stably. As a result, when the PDP has the rectangular projections in the positive slits 1613 and 1615 which create discharges, a white color temperature is increased because the brightness of each color cell can be adjusted relatively by modifying the respective sizes of the transparent electrodes 1602, 1604, 1606 and 1608 in each color cell as mentioned above.

Figure 17:
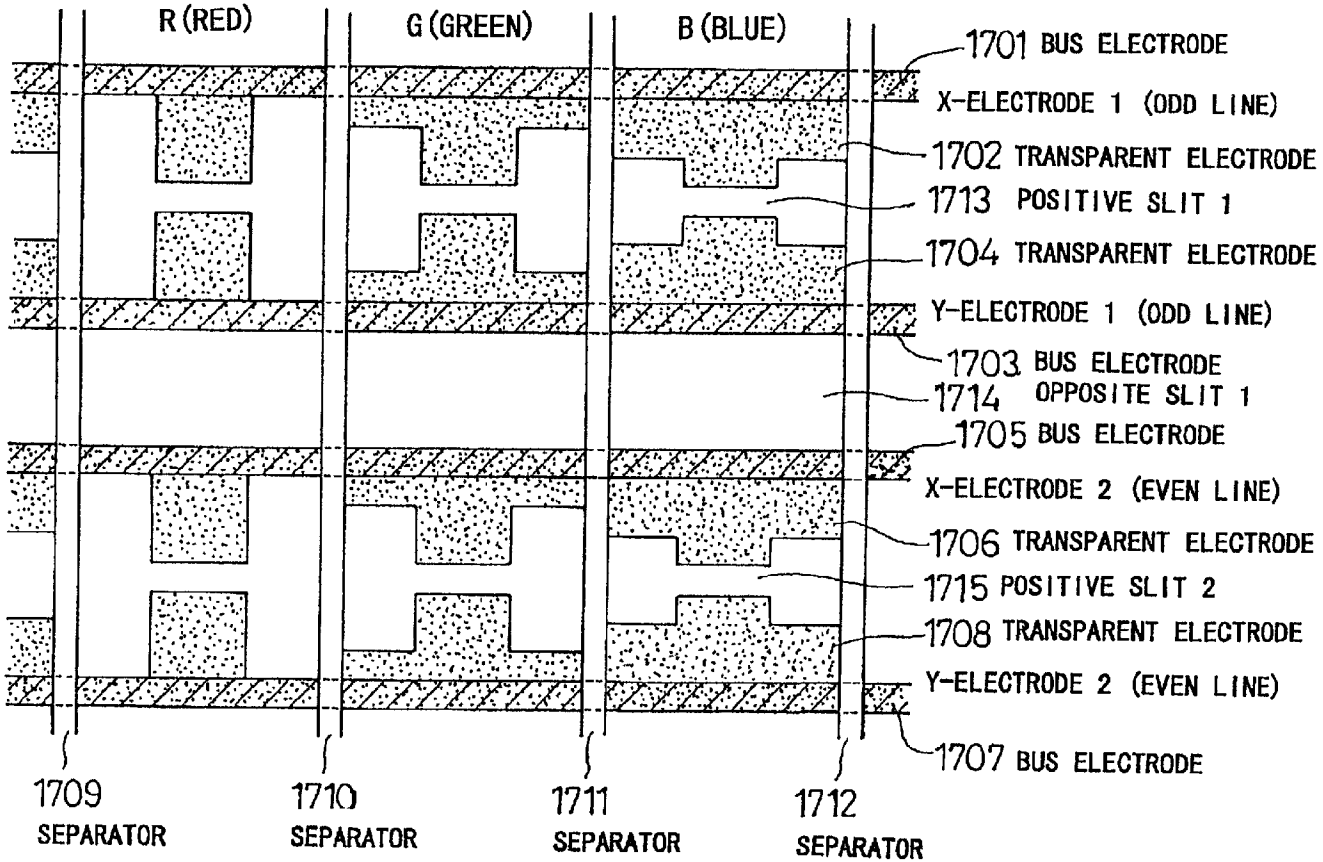
FIG. 17 shows a plan view of a PDP of an eleventh embodiment according to the present invention.

Next, an eleventh embodiment of the present invention will be explained. FIG. 17 shows a plan view of a PDP of the eleventh embodiment according to the present invention. In this embodiment, each of transparent electrodes 1702, 1704, 1706 and 1708 has rectangular projections as shown in FIG. 17 in each of positive slits 1713 and 1715 of red, green and blue cells, which create discharges. Blue electrodes and green electrodes of the transparent electrodes 1702, 1704, 1706 and 1708 are extended in a direction of the positive slits 1713 and 1715 without changing a distance between the rectangular projections. Particularly, the blue electrodes are extended so as to be larger than the green electrodes. As a result, when the PDP has the rectangular projections in the positive slits 1513 and 1515 which create discharges, a white color temperature is increased because the brightness of each color cell can be adjusted relatively by modifying each size of the transparent electrodes 1702, 1704, 1706 and 1708 in each color cell as mentioned above.

Figure 18:
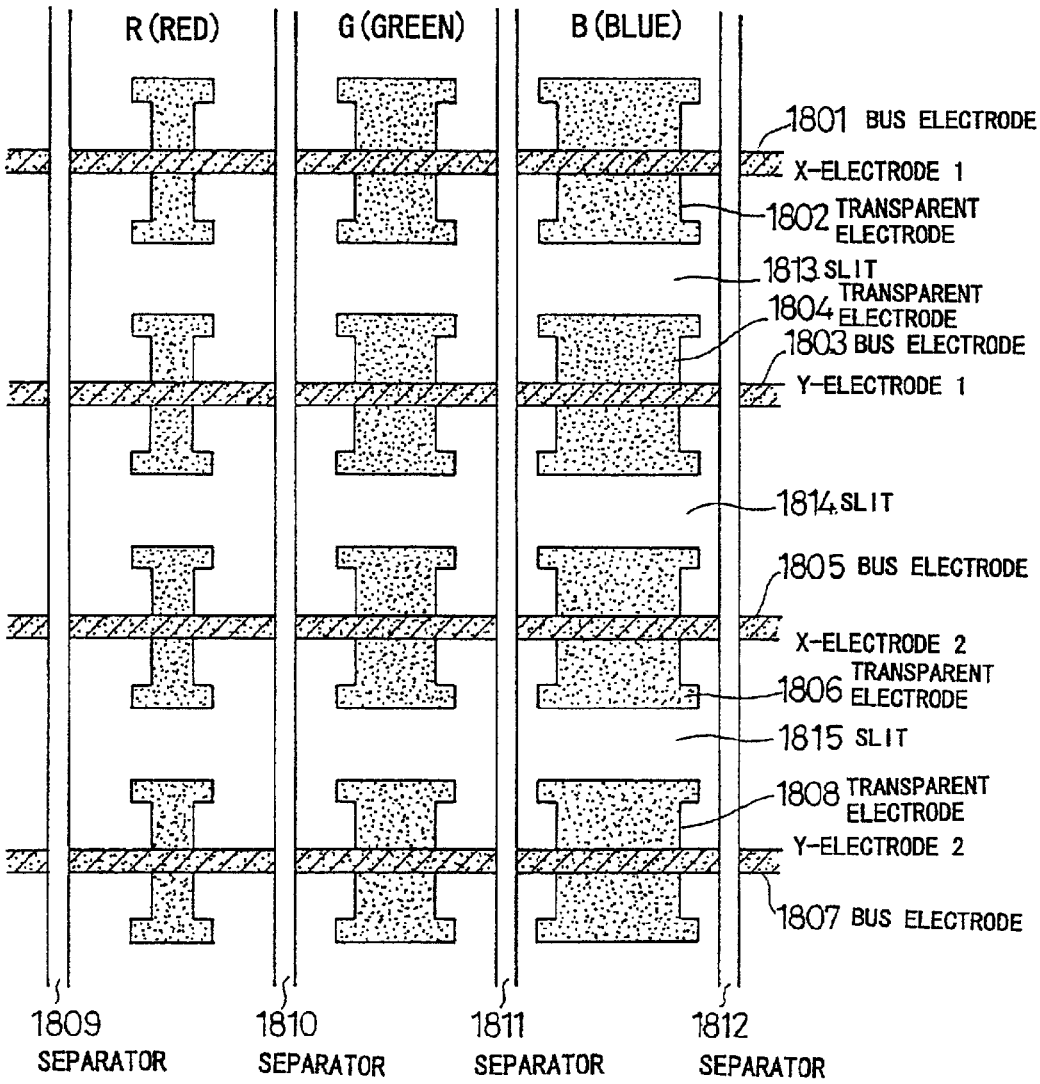
FIG. 18 shows a plan view of a PDP of a twelfth embodiment according to the present invention.

Next, a twelfth embodiment of the present invention will be explained. FIG. 18 shows a plan view of a PDP of the twelfth embodiment according to the present invention. In this embodiment, transparent electrodes 1802, 1804, 1806 and 1808 have T-shaped parts in all slits 1813, 1814 and 1815 of red, green and blue cells, which alternately create discharges. Each T-shaped part comprises a narrow part and a wide part as shown in FIG. 18. In this embodiment, discharges are alternately created at adjacent slits 1813, 1814 and 1815. That is to say, discharges are simultaneously created in both the slit 1813 between the T-shaped part of the transparent electrodes 1802 and the T-shaped part of the transparent electrodes 1804 and the slit 1815 between the T-shaped part of the transparent electrode 1806 and the T-shaped part of the transparent electrode 1808, then, a discharge is created in the slit 1814 between the T-shaped part of the transparent electrode 1804 and the T-shaped part of the transparent electrode 1806 at a next time. In this embodiment, the T-shaped parts of blue electrodes and green electrodes of the transparent electrodes 1802, 1804, 1806 and 1808 are extended in a direction parallel to bus electrodes 1801, 1803, 1805 and 1807, while a length of the slits 1813, 1814 and 1815 is unchanged. Particularly, the blue electrodes are extended so as to be larger than the green electrodes. As a result, when the PDP has T-shaped parts in the slits 1813, 1814 and 1815 which alternately create discharges, a white color temperature is increased because the brightness of each color cell can be adjusted relatively by modifying each size of the transparent electrodes 1802, 1804, 1806 and 1808 in each color cell as mentioned above.

Figure 19:
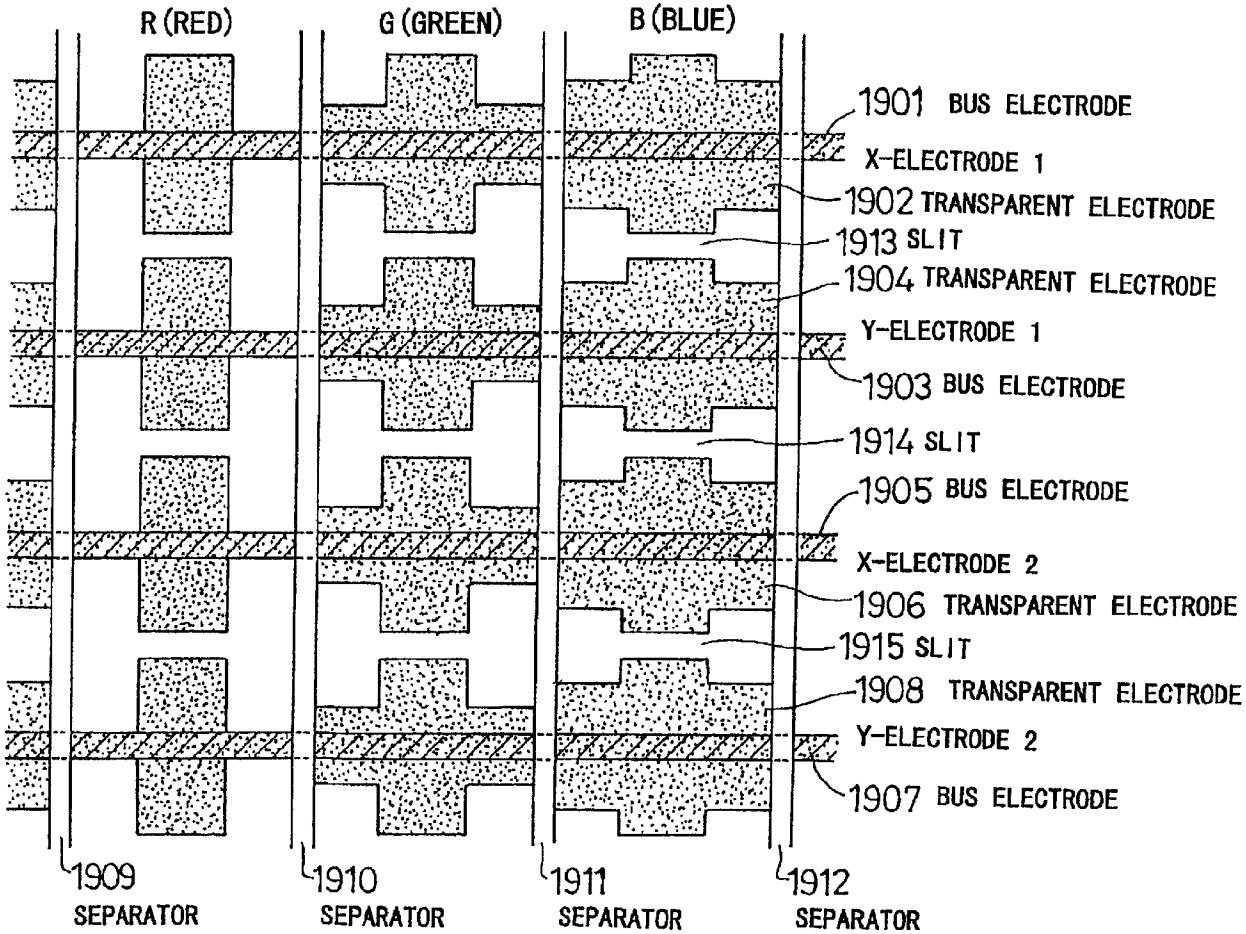
FIG. 19 shows a plan view of a PDP of a thirteenth embodiment according to the present invention.

Next, a thirteenth embodiment of the present invention will be explained. FIG. 19 shows a plan view of a PDP of the thirteenth embodiment according to the present invention. In this embodiment, each of transparent electrodes 1902, 1904, 1906 and 1908 has projections as shown in FIG. 19 in all slits 1913, 1914 and 1915 of red, green and blue cells, which alternately create discharges. In this embodiment, discharges are alternately created at adjacent slits 1913, 1914 and 1915. That is to say, discharges are simultaneously created in both the slit 1913 between the projections of the transparent electrode 1902 and the projections of the transparent electrode 1904 and the slit 1815 between the projections of the transparent electrode 1906 and the projections of the transparent electrode 1908. Then, a discharge is created in the slit 1914 between the projections of the transparent electrode 1904 and the projections of the transparent electrode 1906 at a next time. In this embodiment, the blue electrodes and green electrodes of the transparent electrodes 1902, 1904, 1906 and 1908 are extended in a direction of the slits 1913, 1914 and 1915, while a length of the slits 1813, 1814 and 1815 between the projections is unchanged. Particularly, the blue electrodes are extended so as to be larger than the green electrodes. As a result, in a case that the PDP has the projections in the slits 1913, 1914 and 1915 which alternately create discharges, a white color temperature is increased because the brightness of each color cell can be adjusted relatively by modifying each size of the transparent electrodes 1902, 1904, 1906 and 1908 in each color cell as mentioned above.

Next, a fourteenth embodiment of the present invention will be explained.

Figure 20:
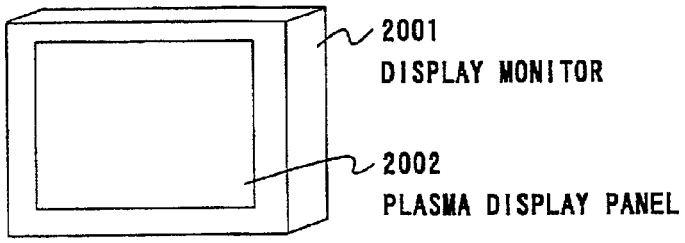
FIG. 20 shows a display monitor in which a PDP according to the present invention is provided.
Figure 2:
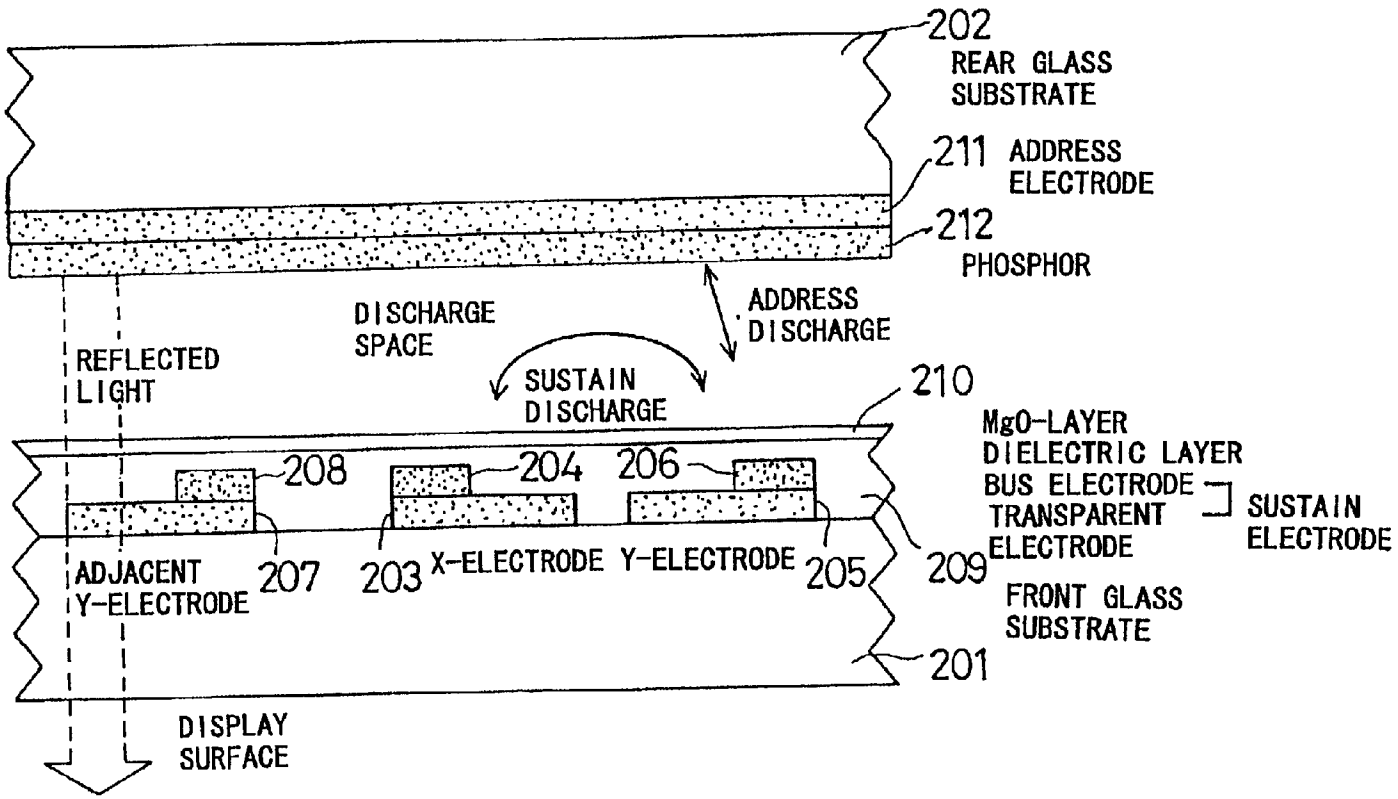
FIG.2 PRIOR ART
FIG. 2 shows a cross section in a direction parallel to address electrodes of the PDP shown in FIG. 1.
Figure 3:
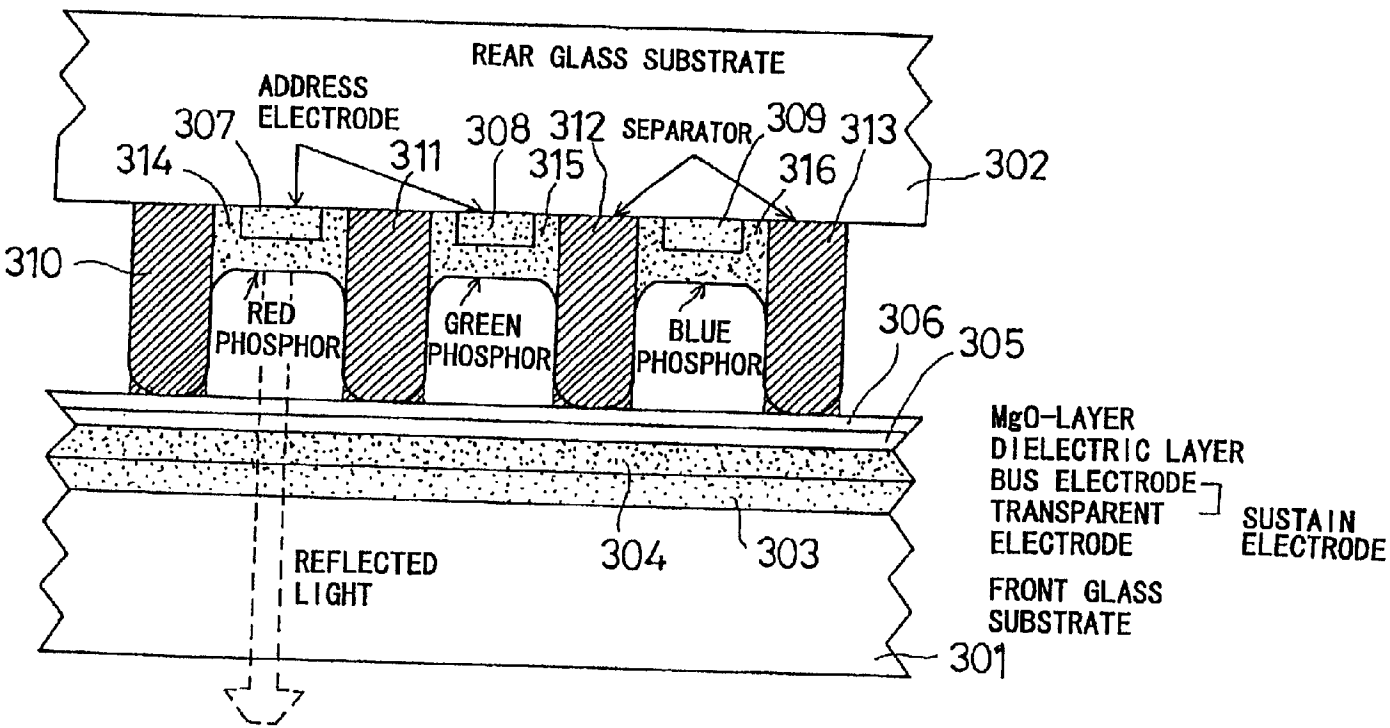
FIG.3 PRIOR ART
FIG. 3 shows a cross section in a direction parallel to X-electrodes of the PDP shown in FIG. 1.
Figure 4:
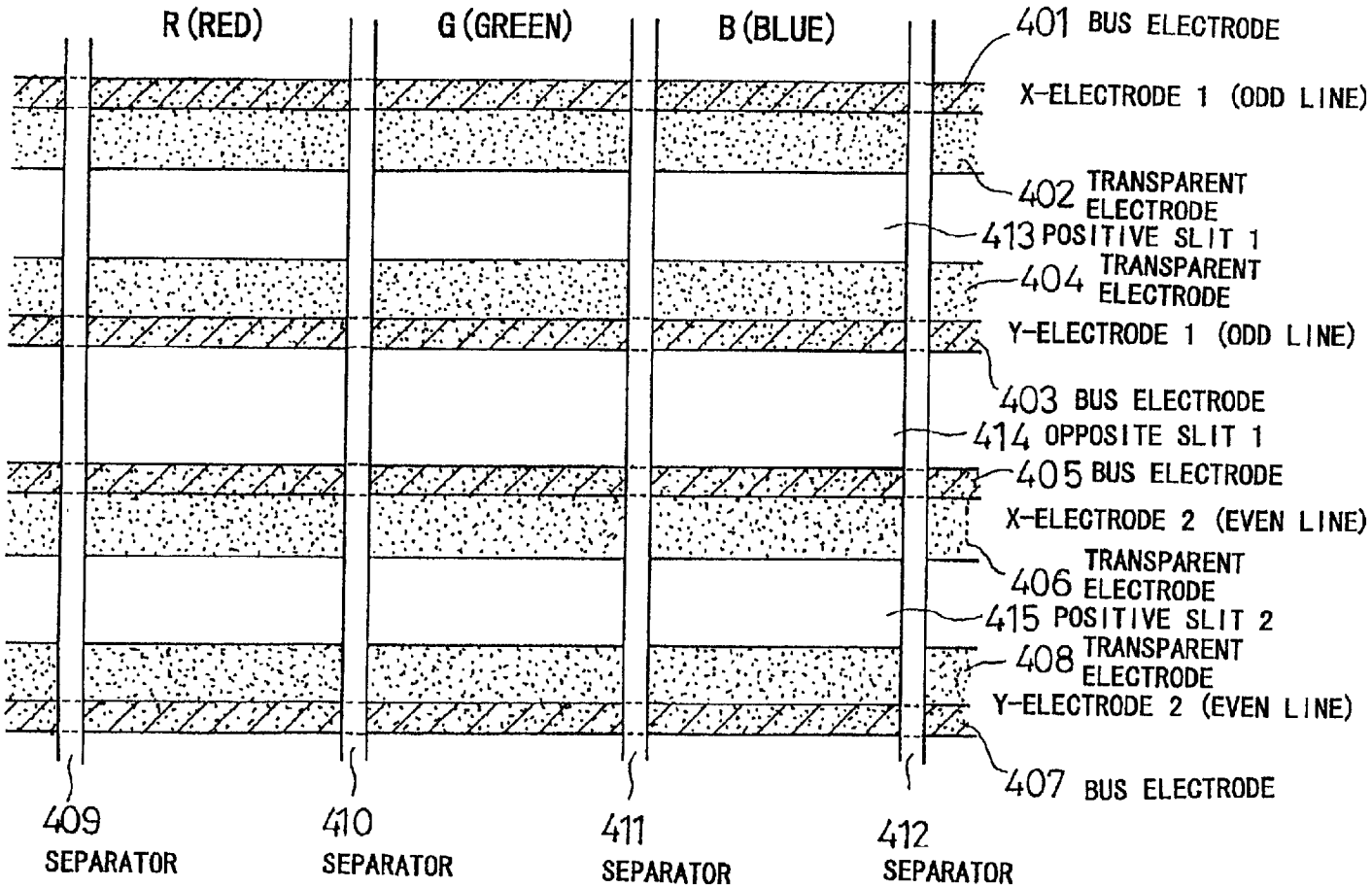
FIG.4 PRIOR ART
FIG. 4 show a plan view of sustain electrodes for red, green and blue phosphors.

FIG. 20 shows a display monitor in which a PDP according to the present invention is provided. A display monitor 2001 has a PDP 2002 according to the present invention. The PDP 2002 according to the present invention can also be applied to a television receiver.

In the disclosed embodiments mentioned above, blue and green electrodes are relatively extended to increase brightness of both blue and green phosphors. However, it is possible to arbitrarily modify areas of red, green and blue electrodes so that a particular white color temperature may be created. In the disclosed embodiments mentioned above, color AC-PDPs were explained. However, the present invention is not limited to the specifically disclosed embodiments and is applicable to all kinds of PDPs for color displays. Furthermore, the PDPs having the electrodes according to the present invention can be easily manufactured using a conventional manufacturing process if only mask patterns for the electrodes are modified.

The present invention is not limited to the specifically disclosed embodiments, and variations and modifications may be made without departing from the scope of the present invention.

The present application is based on Japanese priority application No. 11-074478 filed on Mar. 18, 1999, the entire contents of which are hereby incorporated by reference.

What is claimed is:

1. A plasma display panel comprising:

plural kinds of phosphors producing light emissions of respective, different colors;

separators which separate said plural kinds of phosphors; and plural discharge cells having sustain electrode pairs which produce surface discharges to create the light emissions from said phosphors;

each of said sustain electrode pairs comprising a first electrode and a second electrode, each thereof having a transparent electrode comprising T-shaped parts and each T-shaped part comprising a narrow part and a wide part; and respective sizes of said sustain electrode pairs and respective distances between said sustain electrode pairs in plural discharge cells being different, according to corresponding, different brightness of the light emissions from respective, different phosphors in the plural discharge cells.

2. The plasma display panel as claimed in claim 1, wherein a size of said sustain electrode pair in discharge cells where a phosphor having low brightness is deposited is larger than a size of said sustain electrode pair in discharge cells where a phosphor other than said phosphor having a low brightness is deposited.

3. The plasma display panel as claimed in claim 2, wherein a size of said sustain electrode pair in discharge cell having a red phosphor therein is the same as a size of said sustain electrode pair in a discharge cell having a green phosphor therein, and a size of said sustain electrode pair in a discharge cell having a blue phosphor therein is larger than the size of said sustain electrode pair in a discharge cell having either the red or the green phosphor therein.

4. The plasma display panel as claimed in claim 1, wherein a size of said sustain electrode pair in a discharge cell having a green phosphor therein is larger than a size of said sustain electrode pair in a discharge cell having a red phosphor therein, and a size of said sustain electrode pair in a discharge cell having a blue phosphor therein is larger than the size of said sustain electrode pair in a discharge cell having either the red or the green phosphor therein.

5. The plasma display panel as claimed in claim 1, wherein said T-shaped parts are provided on both sides of said first electrode and said second electrode, and wherein each transparent electrode comprising said T-shaped parts, in said discharge cells having green or blue phosphors therein, is extended in directions of said both sides, to increase said sizes of said sustain electrode pairs therein.

6. The plasma display panel as claimed in claim 1, wherein said narrow part and said wide part of each transparent electrode of said sustain electrode pair in said discharge cells having green or blue phosphors therein are extended in a direction parallel to said first electrode and said second electrode, to increase said sizes of said sustain electrode pairs therein.

7. A plasma display panel, comprising:

plural kinds of phosphors emitting respective, different colors;

separators separating said plural kinds of phosphors;

plural discharge cells individually having a respective one of the plural kinds of phosphors therein and having respective sustain electrode pairs selectively producing surface discharges in the plural discharge cells, creating corresponding light emissions of respective, different colors from said plural phosphors;

each sustain electrode pair comprising a first electrode and a second electrode, each thereof having a transparent electrode comprising T-shaped parts and each T-shaped part having a narrow part and a wide part; and respective sizes of said sustain electrode pairs and respective distances between said sustain electrode pairs in plural discharge cells being different, according to corresponding, different brightness of the light emissions from the respective, different phosphors in the plural discharge cells.

8. A plasma display panel as claimed in claim 7, wherein a size of said sustain electrode pair, associated with discharge cells for which the respective phosphor has a low brightness, is larger than a size of said sustain electrode pair associated with discharge cells for which the respective phosphor has a brightness othern than the low brightness.

9. The plasma display panel as recited in claim 8, wherein a size of said sustain electrode pair associated with discharge cells in which a red phosphor is deposited is the same as the size of said electrode pair associated with discharge cells in which a green phosphor is deposited, and a size of said sustain electrode pair associated with discharge cells in which blue phosphor is deposited is larger than the respective sizes of said sustain electrode pairs associated with corresponding discharge cells in which the red and green phosphors, respectively, are deposited.

10. The plasma display panel as recited in claim 7, wherein a size of said sustain electrode pair associated with discharge cells in which a red phosphor is deposited is the same as the size of said electrode pair associated with discharge cells in which a green phosphor is deposited, and a size of said sustain electrode pair associated with discharge cells in which a blue phosphor is deposited is larger than the respective sizes of said sustain electrod pairs associated with corresponding discharge cells in which the red and green phosphors, respectively, are deposited.

11. The plasma display panel as claimed in claim 7, wherein said T-shaped parts are provided on both sides of said first electrode and said second electrode and wherein each transparent electrode comprising said T-shaped parts, in said discharge cells having green or blue psosphors therein, is extended in directions of said both sides, to increase said sizes of said sustain electrode pair therein.

12. The plasma display panel as claimed in claim 7, wherein said narrow part and said wide part of each transparent electrode of said sustain electrode pair in said discharge cells having green or blue phosphors therein are extended in a direction parallel to said first electrode and said second electrode, to increase said sizes of said sustain electrode pairs therein.

* * * * *

UNITED STATES PATENT AND TRADEMARK OFFICE

CERTIFICATE OF CORRECTION

PATENT NO. : 6,882,114 B2
DATED : April 19, 2005
INVENTOR(S) : Takahiro Takamori et al.

It is certified that error appears in the above-identified patent and that said Letters Patent is hereby corrected as shown below:

Column 10,
Line 30, change “brightness” to -- brightnesses --;

Column 11,
Line 20, change “brightness” to -- brightnesses --;
Line 28, change “othern” to -- other --;

Column 12,
Line 14, change “electrod” to -- electrode --;
Line 19, after “electrode” (second occurrence) insert -- , --.

Signed and Sealed this

Third Day of January, 2006

JON W. DUDAS
*Director of the United States Patent and Trademark Office*